US011788697B1

(12) United States Patent
Chen

(10) Patent No.: US 11,788,697 B1
(45) Date of Patent: Oct. 17, 2023

(54) MULTI-FUNCTIONAL EASY OPERATION LAMP WITH AN OUTLOOK LIKE A CANDLE

(71) Applicant: Wei Chen, Taipei (TW)

(72) Inventor: Wei Chen, Taipei (TW)

( * ) Notice: Subject to any disclaimer, the term of this patent is extended or adjusted under 35 U.S.C. 154(b) by 0 days.

(21) Appl. No.: 18/155,056

(22) Filed: Jan. 16, 2023

(51) Int. Cl.

| | |
|---|---|
| ***F21S 10/04*** | (2006.01) |
| ***F21S 9/03*** | (2006.01) |
| ***F21V 23/04*** | (2006.01) |
| ***F21V 23/06*** | (2006.01) |

(52) U.S. Cl.
CPC ..... *F21S 10/04* (2013.01); *F21S 9/03* (2013.01); *F21V 23/0485* (2013.01); *F21V 23/06* (2013.01)

(58) Field of Classification Search
CPC ... F21S 6/001; F21S 10/04; F21S 9/03; F21V 23/0485; F21V 23/06
See application file for complete search history.

(56) References Cited

U.S. PATENT DOCUMENTS

| | | | | |
|---|---|---|---|---|
| 11,641,705 | B2 * | 5/2023 | Boucher | H05B 47/11 315/159 |
| 2013/0329406 | A1 * | 12/2013 | Lederer | F21L 4/08 362/183 |
| 2019/0032904 | A1 * | 1/2019 | Wang | F21S 6/001 |

* cited by examiner

*Primary Examiner* — Peggy A Neils

(57) ABSTRACT

A multi-functional easy operation lamp with an outlook like a candle includes a lamp body having a casing formed of wax; at least one light source in the lamp body; a power joint arranged within the lamp body; the power joint being connected to a control switch through a conductive wire; one end of the power joint being a plug which is exposed out of the casing; the control switch serving to control on and off operation of the at least one light source; a touch control chip positioned within the lamp body; the touch control chip being connected to the control switch of the light sources through a second conductive wire for switching the control switch; an induction coil extending from the touch control chip; the induction coil being arranged to be near an outer wall of the casing, or the induction coil being arranged on a circuit board.

16 Claims, 9 Drawing Sheets

MULTI-FUNCTIONAL EASY OPERATION LAMP WITH AN OUTLOOK LIKE A CANDLE

FIELD OF THE INVENTION

The present invention is related to lamps, and in particular to a multi-functional easy operation lamp with an outlook like a candle.

BACKGROUND OF THE INVENTION

Lamps are useful tools in daily life. Currently, human cannot live without lamps. In many situation, people use candles as light sources, for example in some religious ceremonies, candles are used for illumination, because candles can present very beautiful light sense and inspire those enjoying the feeling of the ceremonies. However, one candle cannot be used for a long time. It is a short lifetime products, and thus people must replace the candle frequently in the whole processes, while this induces inconvenient in use of light for illumination. As a result, the usage of candle is strictly limited in some applications.

SUMMARY OF THE INVENTION

Accordingly, the object of the present invention is to provide a multi-functional easy operation lamp with an outlook like a candle, wherein the lamp body could present the same effect as a candle, while the lamp body of the present invention has a long lifetime, but a candle has only limited lifetime. The touch control switch of the present invention is not seen in the market, which is used to replace conventional key switch. The touch control chip can be installed to be near any part of the outer surface of the casing, this is a great progress as comparing with the conventional design. Furthermore, the present invention is a user friendly design, the user only needs to touch the surface of the casing slightly without any large pressing force applied to a switch as the way used in the prior art. Furthermore, the solar panel has the advantage of converting light power into electric power to be stored so as to reduce power consumption, or wireless power charger can be added in the present invention for receiving external wireless electric wave to be converted into electric power, which provides an easy way for charging power.

To achieve above object, the present invention provides a multi-functional easy operation lamp with an outlook like a candle; comprising: a lamp body having a casing formed of wax; at least one light source in an interior of the lamp body; light emitted from the light source emitting out through the casing; a power joint arranged within the lamp body; the power joint being connected to a control switch through a conductive wire; one end of the power joint being a plug which is exposed out of the casing; the control switch serving to control on and off operation of the at least one light source; a touch control chip positioned within the lamp body; the touch control chip being connected to the control switch of the light sources through a second conductive wire for switching the control switch; an induction coil extending from the touch control chip; the induction coil being arranged to be near an outer wall of the casing, or the induction coil being arranged on a circuit board. When a user is near the induction coil of the touch control chip, by touching an outer side of the casing, the induction coil is induced; then the induction coil actuates the touch control chip to cause the control switch to switch on or off the light sources.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 4:
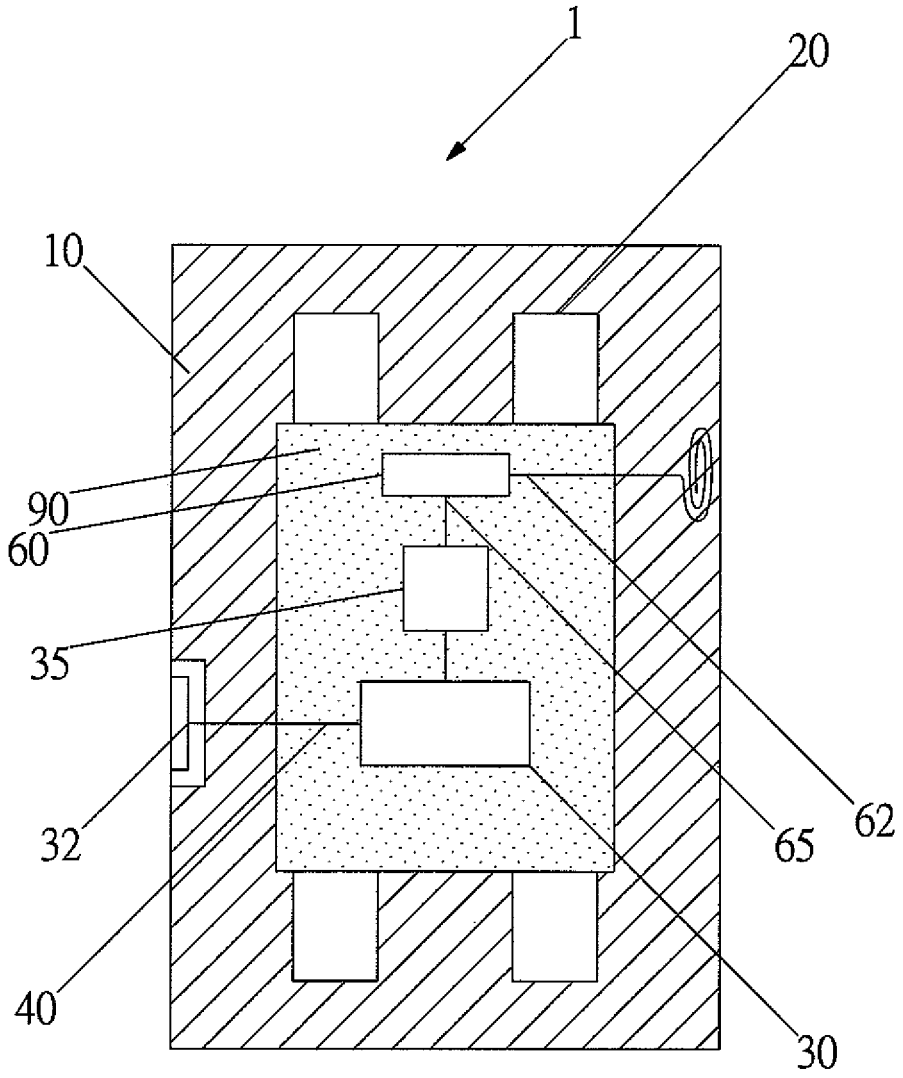
FIG. 4 is a cross section view of the lamp body of the present invention.

A lamp body 1 has a casing 10 formed of wax, as illustrated in FIG. 4. In the present invention, the material of the casing 10 is for example, paraffin, animal wax, plant wax, coal wax, gasoline wax, etc.

Figure 1:
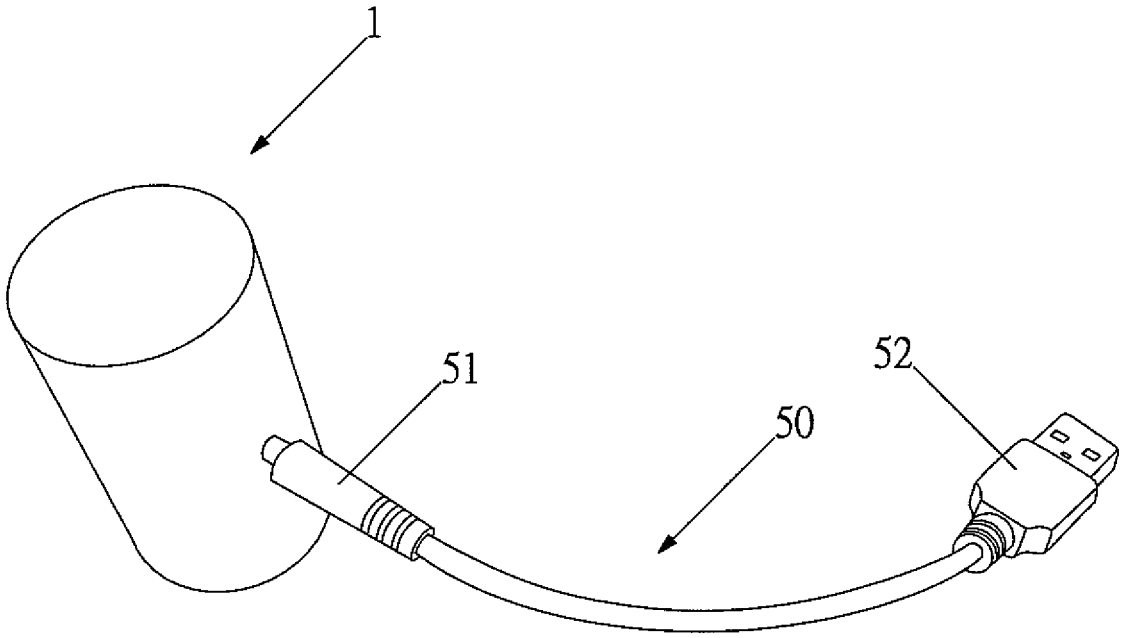
FIG. 1 shows the outlook of the present invention.
Figure 2:
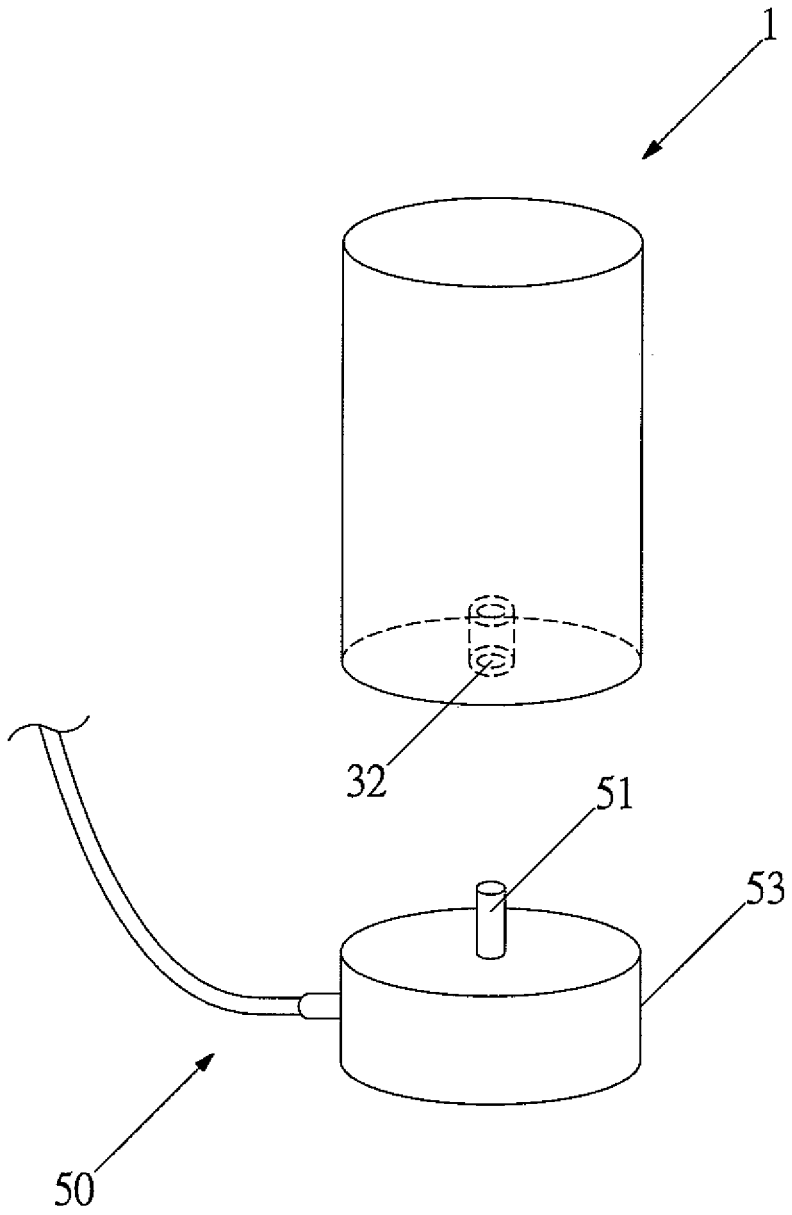
FIG. 2 is another outlook view of the present invention.
Figure 3:
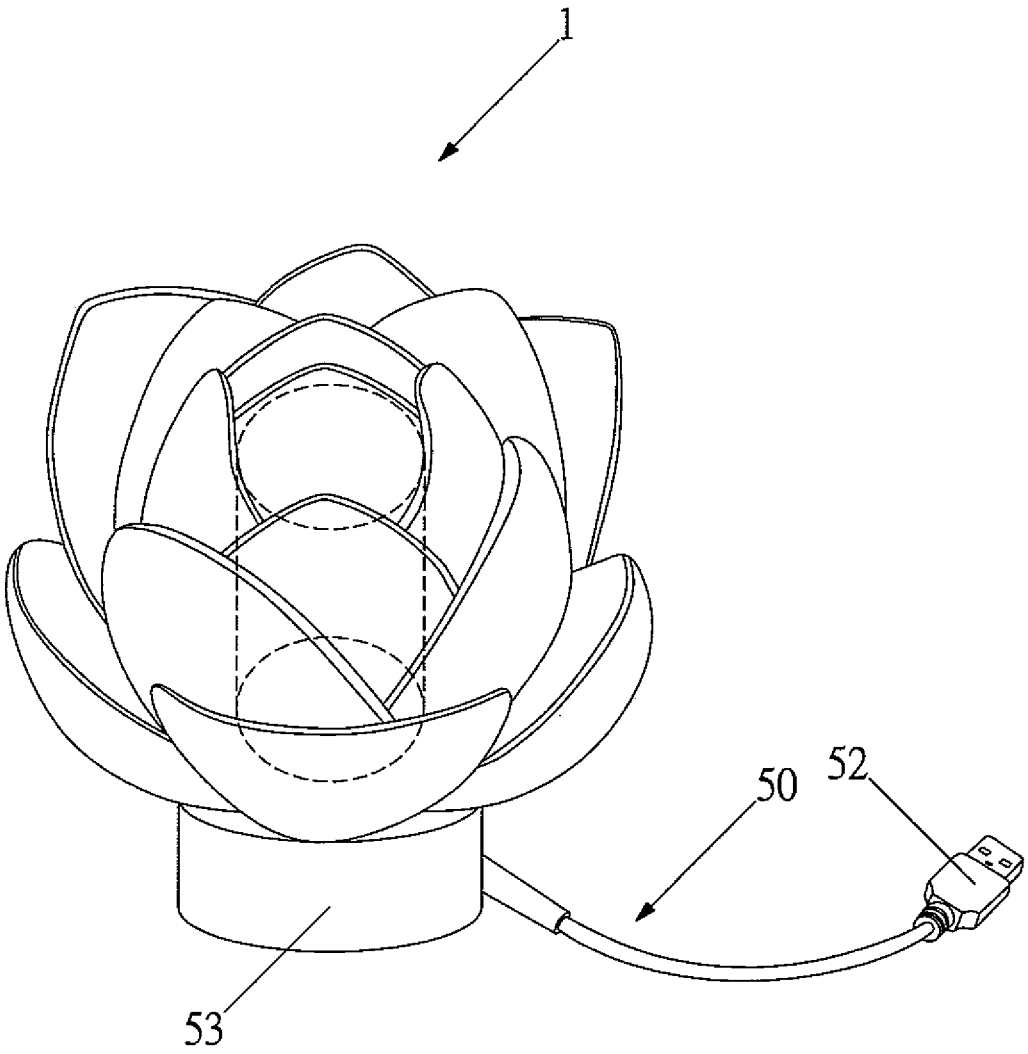
FIG. 3 is a further outlook view of the present invention.

In the present invention, the lamp body 1 may have different forms, such as that shown in FIG. 1, it has an oblong cylindrical shape, while in FIG. 2, the casing 1 has a shape of a lotus. It is suitable for using in religion. At least one light source 20 is in an interior of the lamp body 1.

Light emitted from the light source 20 will emit out through the casing 10. As illustrated in FIG. 4, it is illustrated that four light sources are presented in this embodiment, two in an upper side and the other two are located in a lower side. However, this arrangement is not used to confine the scope of the present invention, light sources of other number and other arrangement are permissible in the present invention.

A battery 30 is arranged within the lamp body 1. The battery 30 is connected to the light source 20 through a control switch 35 for power storage.

A power joint 32 is arranged within the lamp body 1. The power joint 32 is connected to the battery 30 through a conductive wire 40. One end of the power joint 32 is a plug which is exposed out of the casing 20.

The present invention further includes an external power wire 50. One end of the external power wire 50 is an external joint 51 which can be inserted into the power joint 32 and another end thereof is a plug 52 capable of being connected to an external power source (not shown) for power charge to the battery 30, or conducting power to the light sources 20.

In the present invention, the power joint 32 exposes out of the casing 10, as illustrated in FIG. 4, however this is not used to confine the scope of the present invention. The power joint 32 can be also place in the bottom of the casing 10. The external power wire 50 and the plug 51 are installed in a base 53. Therefore, the lamp body 1 stands on the base 53 by the external joint 51 inserting into the power joint 32.

A touch control chip 60 is positioned within the lamp body 1. An induction coil 62 extends from the touch control chip 60. The touch control chip 60 is connected to a control switch 35 of the light sources 20 through a conductive wire 65 for switching the control switch 35. The induction coil 62 is arranged to be near an outer wall of the casing 10.

The present invention further includes a control panel 90 for installing the battery 30, the control switch 35 and other elements.

In the first application of the present invention, wax of the casing directly encloses and contacts elements enclosed therein; the elements includes the at least one light source 20, the battery 30, the power joint 32, the touch control chip 60, the induction coil 62, and the control panel 90. That is, in the manufacturing process, these elements are formed firstly and then placed within a mold, next, wax is filled into the mold so that the wax directly contacts these elements. In this structure, light emitted from the wax presents very beautiful visual quality. However, it is difficult to make the structure by this way, this is because it is necessary to overcome the effect of the wax to the element, especially circuit elements therein.

Therefore, when a user is near the induction coil 62 of the touch control chip 60, by touching an outer side of the casing 10, the induction coil 62 is induced. Then the induction coil 62 will actuate the touch control chip 60 to cause the control switch 35 to switch on or off the light sources 20.

In the present invention, the touch control chip 60 and the control switch 35 can be made as an integral structure.

Figure 5:
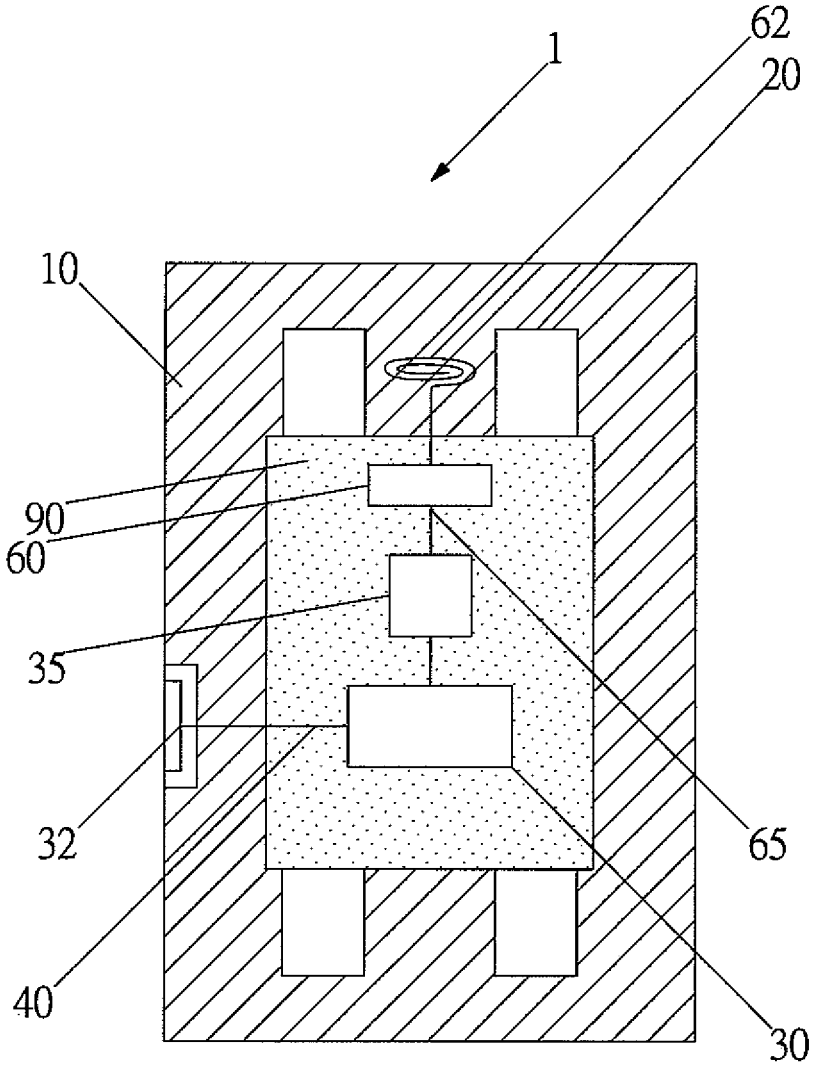
FIG. 5 is a cross section view of the lamp body, showing that the induction coil of the present invention is arranged in a different position.
Figure 9:
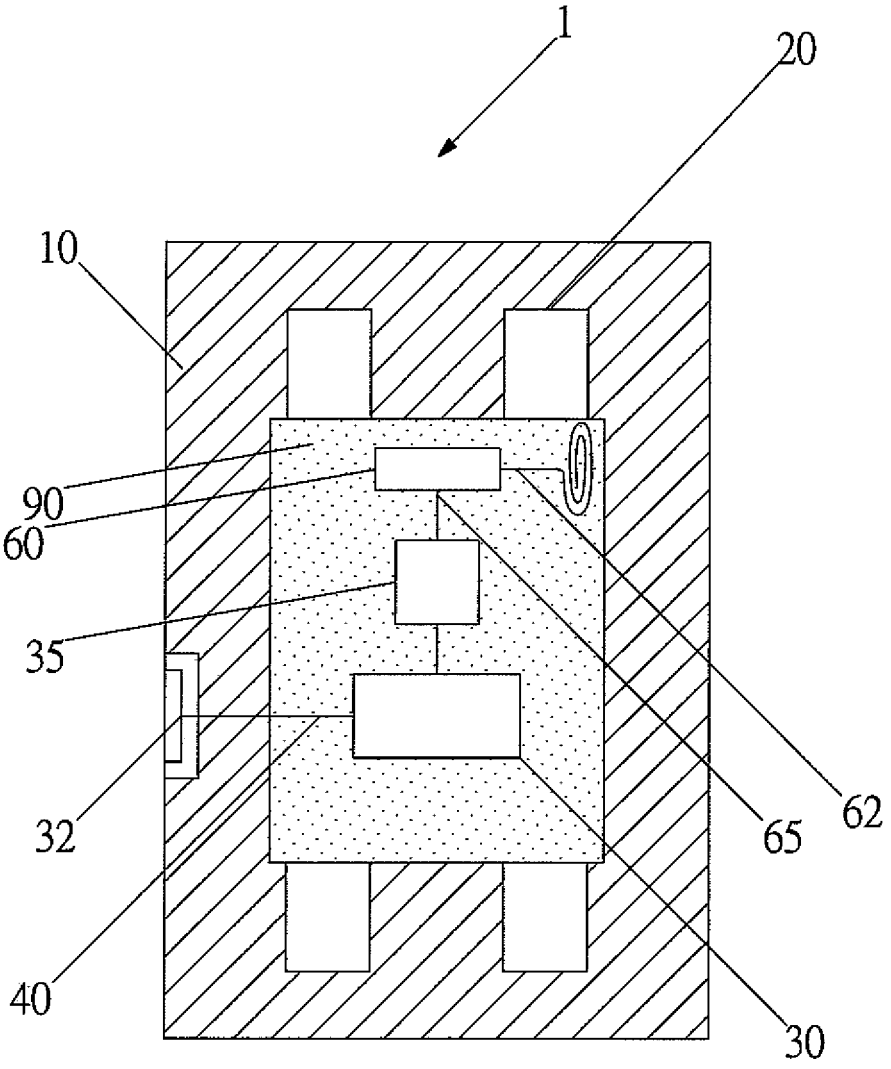
FIG. 9 is a schematic view showing the induction coil is arranged on the circuit board of the present invention.

As illustrated in FIGS. 4 and 5, the induction coil 62 can be buried in any part of the casing 10 so that the user can touch or beat the casing 10 to switch the light sources 20. Preferably, the induction coil 62 is arranged to be near an upper end of the casing 10, as illustrated in FIG. 5. This is because this position is easy in operation. Or, as illustrated in FIG. 9, the induction coil 62 is directly arranged on the circuit board 90.

In the present invention, the illumination of the light sources 20 may be several stages, for instance, continuous illumination, flash, etc. Thus, the user can present different illumination ways by different ways for touching or beating a portion of the casing 10 near the induction coil 62. For example, a first touch is to present continuous illumination, and a second touch is to present flash illumination, and a third touch is to distinguish the light sources 20.

Figure 6:
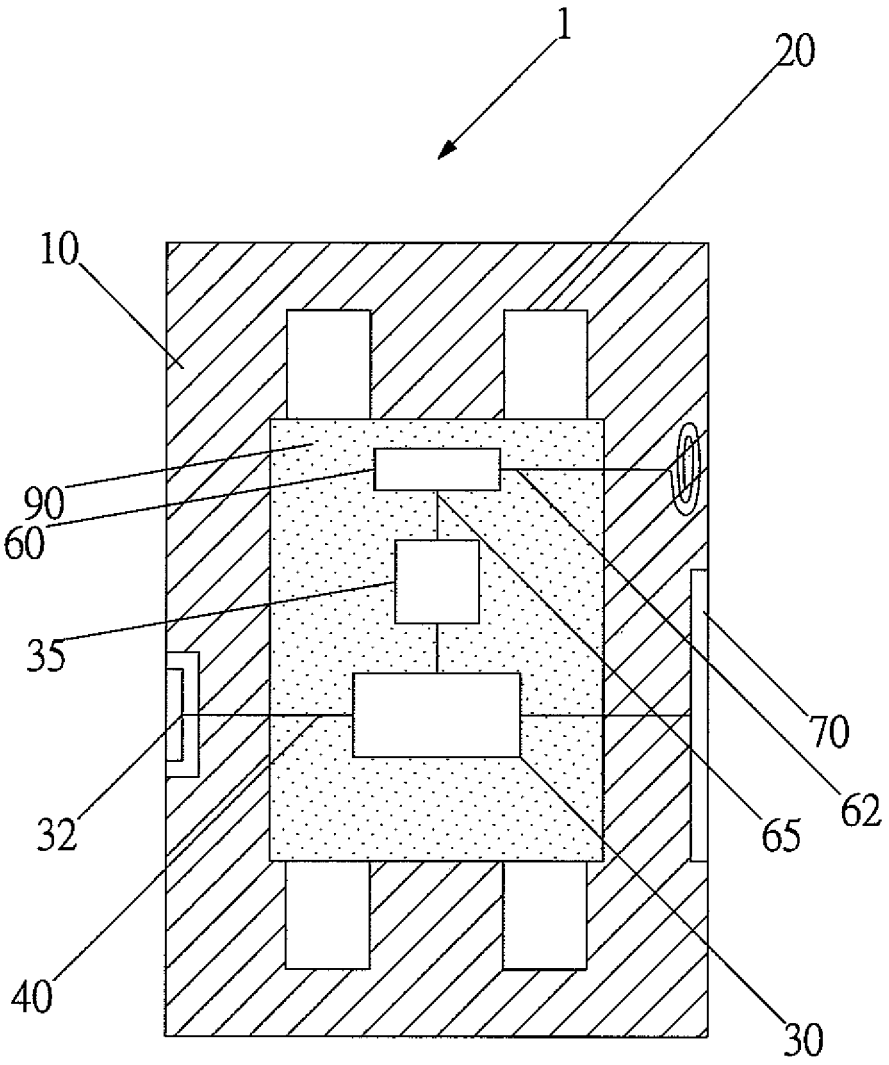
FIG. 6 shows that a solar panel is installed in the lamp body of the present invention.

In the present invention, at least one solar panel 70 can be installed in the lamp body 1. The solar panel 70 exposes out the casing 10, as illustrated in FIG. 6. One section of the solar panel 70 is connected to the battery 30. The solar panel 70 could receive external light power and convert the light power into electric power to be storage in the battery 30.

Figure 7:
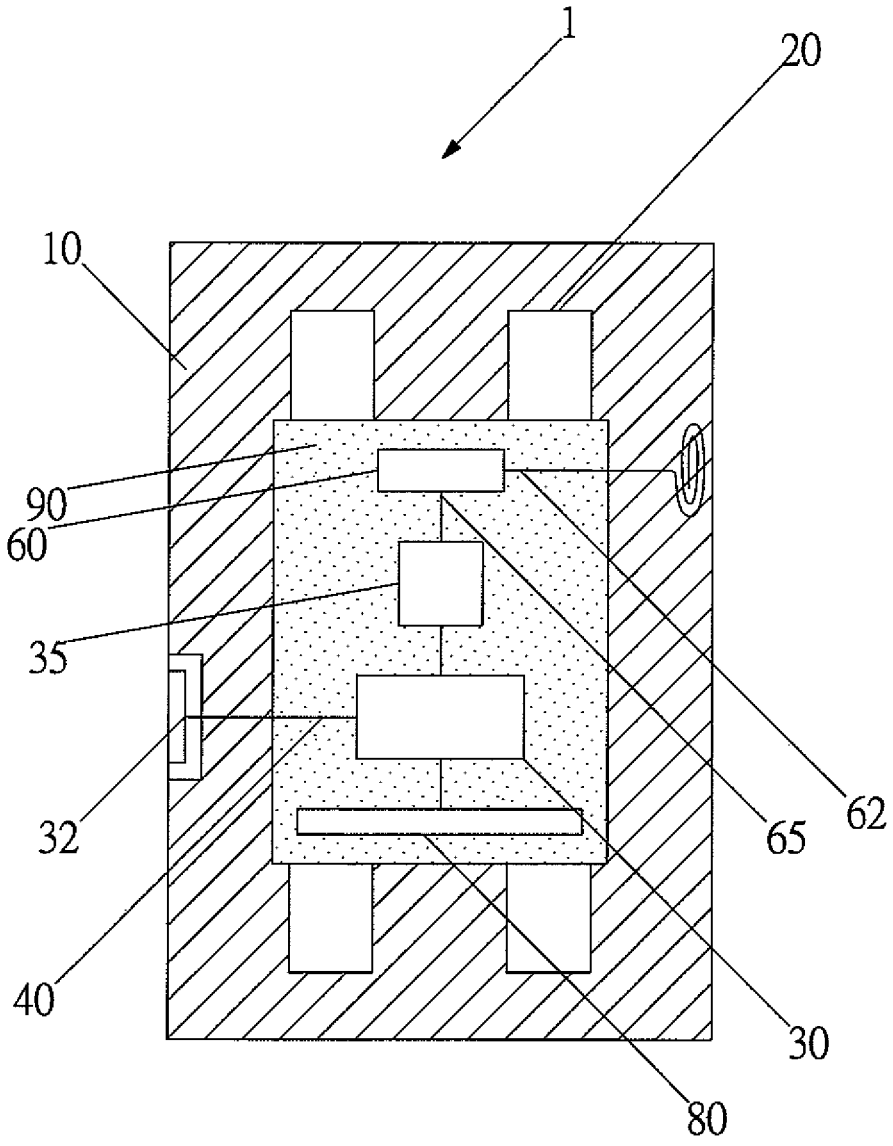
FIG. 7 shows that a wireless power charging plate is installed in the lamp body of the present invention.

As illustrated in FIG. 7, a wireless power charge plate 80 could be installed in the lamp body 1. The wireless power charge plate 80 is connected to the battery 30. The wireless power charge plate 80 serves to receiver external wireless electric waves and then convert the power of the wave into electric power to be stored in the battery 30.

Figure 8:
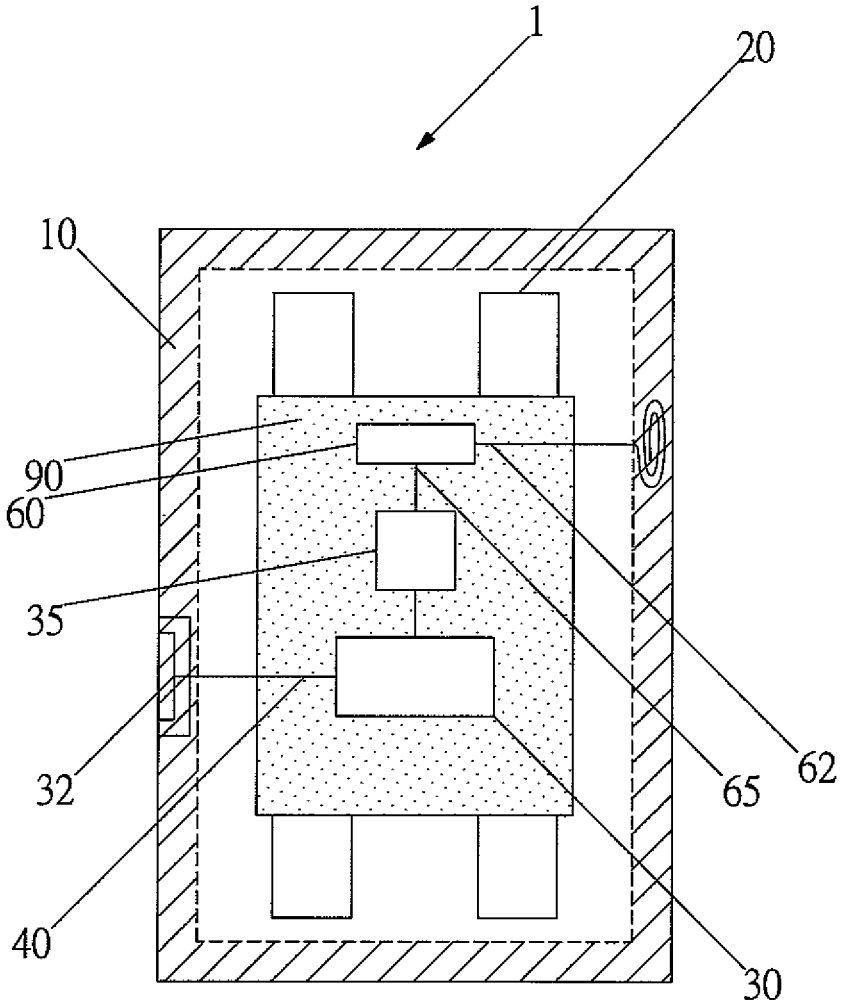
FIG. 8 shows the second embodiment of the present invention, where the casing is hollowed.

Referring to FIG. 8, in the second application of the present invention, an internal of the casing 10 is formed as a hollowed space 15 for receiving related elements, such as light sources 20, battery 30, control switch 35, circuit board 90, etc.

By above mentioned design of the present invention, the lamp body could present the same effect as a candle, while the lamp body of the present invention has a long lifetime, but a candle has only limited lifetime. The touch control switch of the present invention is not seen in the market, which is used to replace conventional key switch. The touch control chip can be installed to be near any part of the outer surface of the casing, this is a great progress as comparing with the conventional design. Furthermore, the present invention is a user friendly design, the user only needs to touch the surface of the casing slightly without any large pressing force applied to a switch as the way used in the prior art. Furthermore, the solar panel has the advantage of converting light power into electric power to be stored so as to reduce power consumption, or wireless power charger can be added in the present invention for receiving external wireless electric wave to be converted into electric power, which provides an easy way for charging power.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A multi-functional easy operation lamp with an outlook like a candle; comprising:

a lamp body having a casing formed of wax;

at least one light source in an interior of the lamp body; light from the light source emitting out through the casing;

a power joint arranged within the lamp body; the power joint being connected to a control switch through a conductive wire; the control switch is connected with the at least one light source for switching the light source; one end of the power joint being a plug which is exposed out of the casing; the control switch serving to control on and off operation of the at least one light source;

a touch control chip positioned within the lamp body; the touch control chip being connected to the control switch of the light sources through a second conductive wire for switching the control switch;

an induction coil extending from the touch control chip; the induction coil being arranged to be near an outer wall of the casing, or the induction coil being arranged on a circuit board; and wherein when a user is near the induction coil of the touch control chip, by touching an outer side of the casing, the induction coil is induced; then the induction coil actuates the touch control chip to cause the control switch to switch on or off the light sources.

2. The multi-functional easy operation lamp with an outlook like a candle as claimed in claim 1, wherein wax of the casing directly encloses and contacts elements enclosed therein; the elements includes the at least one light source, the power joint, the touch control chip and the induction coil; and wherein in manufacturing process, these elements are formed firstly and then placed within a mold, next, wax is filled into the mold so that the wax directly contacts these elements; in this structure, light emitted from the wax presents very beautiful visual quality.

3. The multi-functional easy operation lamp with an outlook like a candle as claimed in claim 1, wherein an interior the casing is formed with a hollow space for receiving elements of the lamp.

4. The multi-functional easy operation lamp with an outlook like a candle as claimed in claim 1, wherein the induction coil is buried in any part of the casing.

5. The multi-functional easy operation lamp with an outlook like a candle as claimed in claim 1, wherein the induction coil is arranged near an upper end of the casing.

6. The multi-functional easy operation lamp with an outlook like a candle as claimed in claim 1, wherein the power joint exposes out of the casing.

7. The multi-functional easy operation lamp with an outlook like a candle as claimed in claim 1, wherein the power joint is placed in a bottom of the casing; the external power wire and the plug are installed in a base; and therefore, the lamp body stands on the base by the external joint inserting into the power joint.

8. The multi-functional easy operation lamp with an outlook like a candle as claimed in claim 1, wherein illumination of the light sources contains several stages; by touching or beating a portion of the casing near the induction coil, the lamp body presents various illumination effects.

9. The multi-functional easy operation lamp with an outlook like a candle as claimed in claim 1, wherein the lamp body has an oblong cylindrical shape.

10. The multi-functional easy operation lamp with an outlook like a candle as claimed in claim 1, wherein the lamp body has a lotus shape.

11. The multi-functional easy operation lamp with an outlook like a candle as claimed in claim 1, further comprising a battery installed within the lamp body; the battery is connected to the power joint, and is also connected to the light source through the control switch for power storage.

12. The multi-functional easy operation lamp with an outlook like a candle as claimed in claim 11, further comprising: an external power wire; one end of the external power wire being an external joint which can be inserted into the power joint and another end thereof is a plug capable of being connected to an external power source for power charge to the battery, or conducting power to the light sources.

13. The multi-functional easy operation lamp with an outlook like a candle as claimed in claim 11, further comprising: at least one solar panel installed in the lamp body; the solar panel exposing out the casing; one section of the solar panel is connected to the battery.

14. The multi-functional easy operation lamp with an outlook like a candle as claimed in claim 11, further comprising: a wireless power charge plate installed in the lamp body; and the wireless power charge plate being connected to the battery.

15. The multi-functional easy operation lamp with an outlook like a candle as claimed in claim 1, further comprising a circuit board for installing other elements.

16. The multi-functional easy operation lamp with an outlook like a candle as claimed in claim 1, wherein the touch control chip and the control switch are made as an integral structure.

* * * * *